US007244882B1

(12) United States Patent
Colwell

(10) Patent No.: US 7,244,882 B1
(45) Date of Patent: Jul. 17, 2007

(54) DRUM KEY

(76) Inventor: Jonathan Colwell, 903 W. 17th St., Costa Mesa, CA (US) 92627

( * ) Notice: Subject to any disclaimer, the term of this patent is extended or adjusted under 35 U.S.C. 154(b) by 0 days.

(21) Appl. No.: 10/621,052

(22) Filed: Jul. 15, 2003

Related U.S. Application Data

(60) Provisional application No. 60/396,295, filed on Jul. 15, 2002.

(51) Int. Cl.
*G10D 13/02* (2006.01)

(52) U.S. Cl. ..... 84/312 R; 84/411 R

(58) Field of Classification Search ..... 84/413, 84/411 A, 458, 411 R
See application file for complete search history.

(56) References Cited

U.S. PATENT DOCUMENTS 3,877,327 A * 4/1975 Erm ..... 81/124.4
4,208,942 A 6/1980 Henrit
4,603,606 A * 8/1986 Headen ..... 81/59.1
5,020,398 A * 6/1991 Leu ..... 81/124.4
D346,100 S 4/1994 Behrenfeld
D366,996 S 2/1996 Torres
5,689,076 A * 11/1997 Usuda ..... 84/458

* cited by examiner

*Primary Examiner*—Lincoln Donovan
*Assistant Examiner*—Jianchun Qin
(74) *Attorney, Agent, or Firm*—Christie, Parker & Hale, LLP

(57) ABSTRACT

Apparatus and methods for rotating objects in accordance with the invention are disclosed. One embodiment of the invention includes a shaft including a socket opening in at least one end of the shaft and a handle connected to the shaft by a unidirectional bearing. An embodiment of the invention adapted for rotating a tension rod having a terminal end includes a shaft including a socket opening in at least one end of the shaft and a handle connected to the shaft by a unidirectional bearing. In this embodiment, the socket opening is capable of engaging the terminal end of the tension rod.

9 Claims, 4 Drawing Sheets

DRUM KEY

CROSS-REFERENCE TO RELATED APPLICATION

This application claims priority of U.S. Provisional Application No. 60/396,295, filed Jul. 15, 2002.

BACKGROUND OF THE INVENTION

In the tuning of a standard drum, a tool is used to tighten or loosen a tension rod. There are typically tension rods equally spaced around the top of a drum which are designed to secure a drum ring (or hoop) to the drum using lugs. The drum ring holds down the head or skin of the drum. Tightening or loosening the tension rods around the drum creates a lower or higher pitch by stretching or loosening the drum head. A drum key is a tool that is often used to tighten or loosen tension rods. Typically, a drum tool has a cylindrical shaft with a wingnut style handle in a fixed position at the top. At the base there is an opening that can engage or mate with the shape of the terminal end of the tension rod. Once a drum key is engaged with a tension rod, the rotation of the drum key causes the tension rod to rotate. The standard drum key is usually a single fixed piece in the shape of a "T".

Ratchet style drum keys are also known and are designed to provide an efficient method of tightening tension rods in circumstances where obstructions would prevent a "T" shaped drum key from performing complete rotations. Ratchet style drum keys can have the disadvantage that there is some play before the ratchet transfers torque. This play before pressure is applied to the tension rod can make ratchet style drum keys imprecise for the purposes of providing fine tuning of the tension in a drum head.

SUMMARY OF THE INVENTION

Embodiments of the present invention provide a method of rotating tuning rods and other similar components of drums. Several embodiments provide speed, efficiency of effort, precision and the ability to operate in the presence of obstructions. One embodiment of the invention includes a shaft including a socket opening in at least one end of the shaft and a handle connected to the shaft by a unidirectional bearing.

In a further embodiment, the shaft has two ends and includes a second socket opening in the other end of the shaft and the unidirectional bearing is a cam clutch unidirectional bearing.

In another embodiment for rotating a tension rod having a terminal end, the invention includes a shaft having a socket opening in at least one end of the shaft and a handle connected to the shaft by a unidirectional bearing. In addition, the socket opening can engage the terminal end of the tension rod.

An embodiment of the method of the invention includes rotating a tension rod using a drum key that includes a shaft with a socket opening in one end and a handle connected to the shaft by a unidirectional bearing.

In a still further embodiment, the rotation of the tension rod involves inserting a portion of the tension rod inside the socket opening of the drum key and rotating the handle of the drum key in a first direction.

Yet another embodiment of the invention also includes rotating the handle of the drum key in a second direction without rotating the tension rod.

In a still further embodiment of the invention again, the rotation of the tension rod further involves holding the handle of drum key stationary and simultaneously rotating the shaft of the drum key.

DETAILED DESCRIPTION OF THE INVENTION

Figure 1:
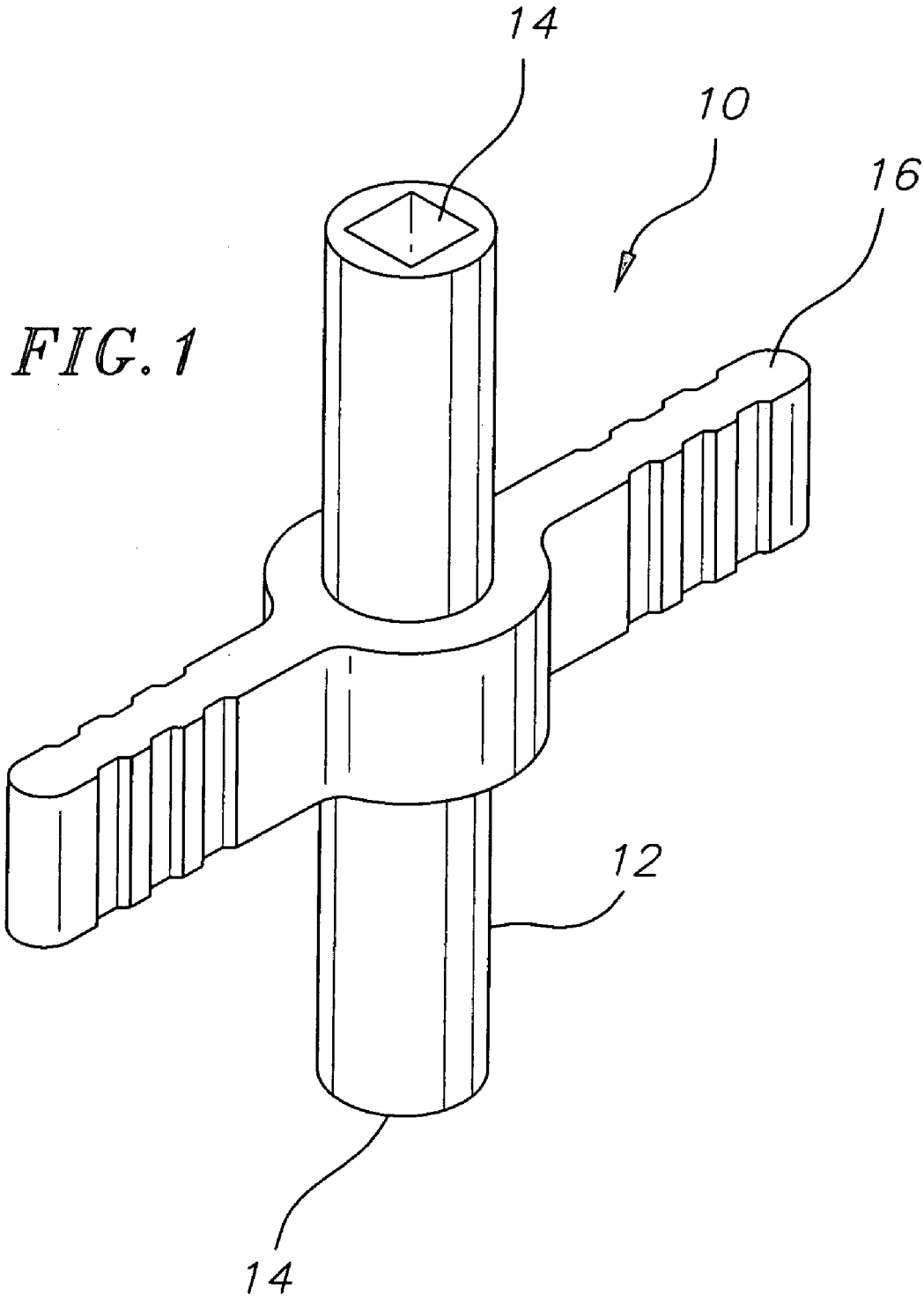
FIG. 1 is a perspective view of a drum key in accordance with the present invention.

Referring now to the drawings, drum keys in accordance with the present invention are illustrated. The drum keys include a central shaft with openings at both ends similar to the openings in a conventional drum key. A handle is rotatably mounted on the central shaft using a unidirectional bearing. The unidirectional bearing can enable precise loosening or tightening of tension rods or other parts of a drum kit. In circumstances where a tension rod is located in a space where obstructions prevent complete rotations of the handle, drum keys in accordance with the present invention can tighten or loosen the tension rod without necessitating the removal of the drum key from the tension rod every time a partial rotation of the tension rod is completed.

Turning now to FIG. 1 an embodiment of a drum key is shown. The drum key 10 includes a shaft 12 with socket openings 14 at both ends. A handle 16 is unidirectionally rotatably mounted at the center of the shaft.

In one embodiment the handle is mounted in the middle of the shaft allowing the key to be used to tighten a tension rod by engaging one of the socket openings over the terminal end of the tension rod and then rotating the handle. The tension rod can be loosened by flipping the drum key and using the other socket opening and repeating the actions described above. In other embodiments the handle can be mounted in other locations along the shaft.

A tension rod typically requires some amount of manual tightening without the use of a drum key prior to the use of a tool being required. Instead of manual tightening, the drum key 10 shown in FIG. 1 can be mounted on the terminal end of the tension rod, the handle can be held in position and the shaft rotated to achieve the same effect. Once the tension rod becomes sufficiently tight, the handle can be used to complete the tightening of the tension rod. The opposite action can be used to loosen the tension rod.

In one embodiment, the handle is designed to spin in one direction and have a precise breaking action when attempting to turn in the opposite direction. Having the handle designed with a unidirectional bearing allows it to transfer torque without significant play. The absence of significant play can enable fine tuning of a drum.

Figures 2A, 2B, 2C:
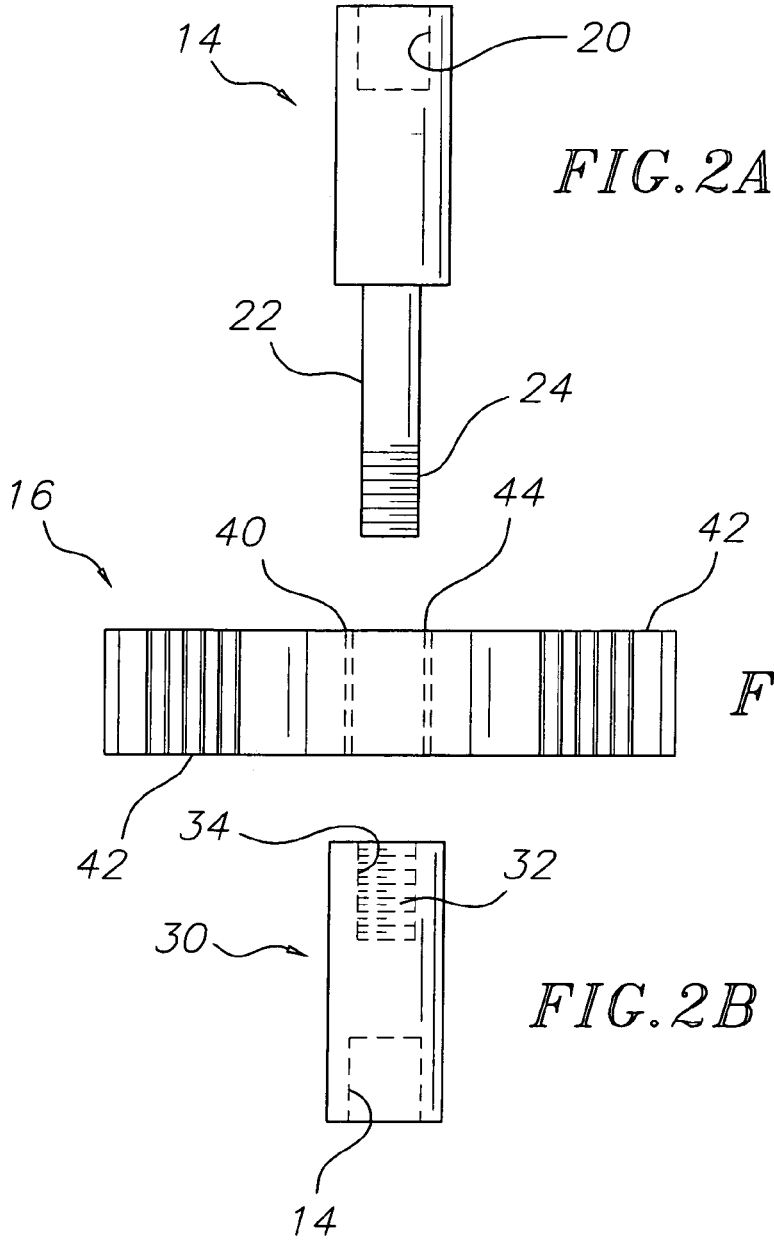
FIG. 2A is a cross-sectional view of a first piece that can be used in the construction of a drum key in accordance with the present invention.
FIG. 2B is a cross-sectional view of a second piece that can be used in the construction of a drum key in accordance with the present invention.
FIG. 2C is a cross-sectional view of a handle that can be used in the construction of a drum key in accordance with the present invention.

The shaft 12 shown in FIG. 1 can be constructed using two pieces. The two pieces used in the construction of the shaft are shown in FIGS. 2A and 2B. A first piece 20 of the shaft shown in FIG. 2A includes a socket opening 14 at one end and a connecting extension 22. The interior surface of the first opening is shaped to mate with or engage the terminal end of a tension rod. The connecting extension can be narrower than the body of the first piece 20 of the shaft and includes a thread 24.

A second piece 30 of the shaft is shown in FIG. 2B. The second piece of the shaft includes a first opening 14 at one end and a second opening 34 at the other end. The interior surface of the first opening is shaped to mate or engage the terminal end of a tension rod. The second opening is shaped to mate with the threaded end of the connecting extension 22 of the first piece 29 of the shaft. The interior surface 34 of the second opening can also be threaded.

An embodiment of a handle is shown in FIG. 2C. The handle 16 includes a central bearing 40 from which two wings 42 extend. The central bearing 40 contains a unidirectional bearing 44 that allows the handle to spin freely in one direction when mounted on the shaft 12.

Bearings are typically characterized as providing a nearly friction free mounting for an object. A unidirectional bearing is a particular type of bearing that only allows free rotation in one direction. Unidirectional bearings are distinct from ratchet mechanisms, because they do not rely on systems involving a gear rotatably mounted on a bearing. In ratchet mechanisms, there is play in the direction opposite the direction of free rotation governed by the spacing of the teeth in the ratchet gear.

Figure 2D:
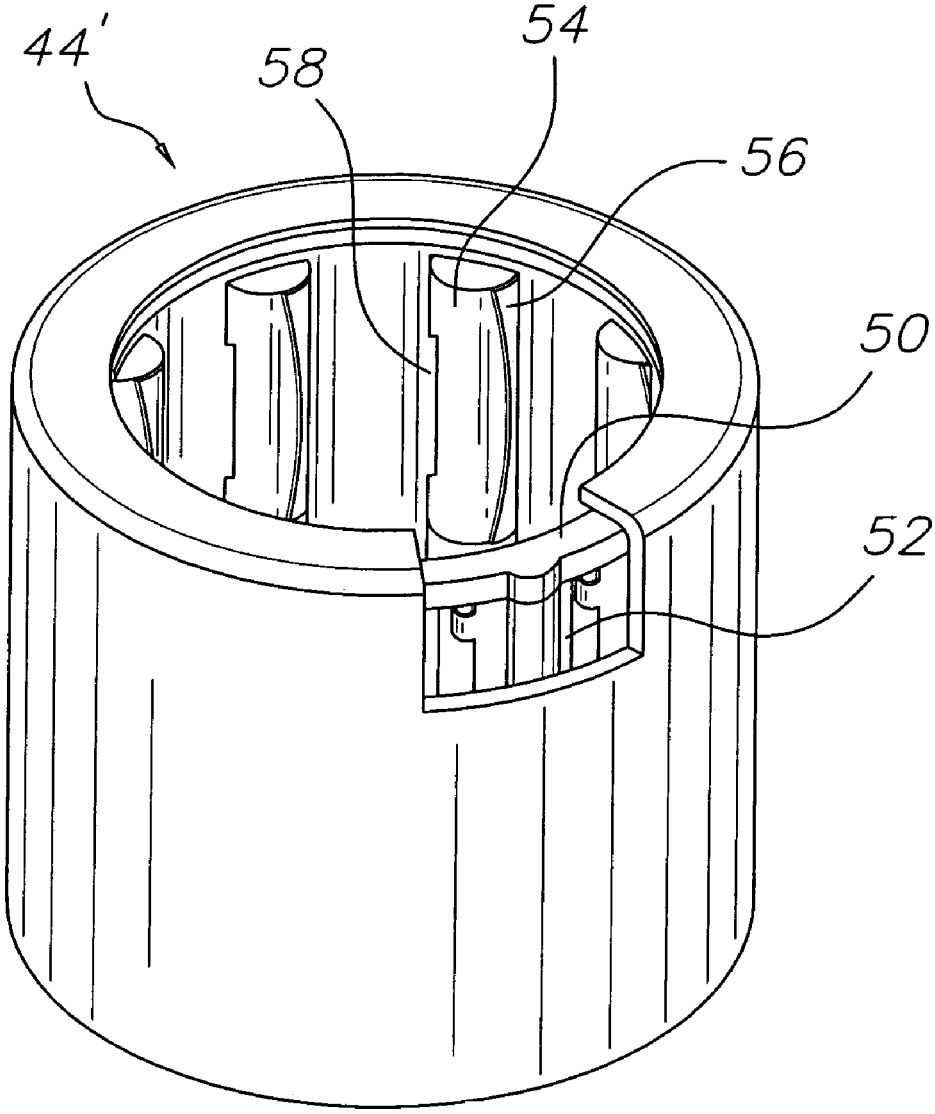
FIG. 2D is a perspective and partial cut away view of an embodiment of a unidirectional bearing capable of incorporation into the handle shown in FIG. 2C in accordance with the present invention.

An embodiment of a cam clutch unidirectional bearing that can be used to implement the unidirectional bearing 44 is shown in FIG. 2C in accordance with the present invention is illustrated in FIG. 2D. The cam clutch bearing 44' consists of ring 50 including a plurality of cavities 52 that contain needle rollers 54 and springs 56. The cavities are elongated to contain the rollers and also include a ramp 58. The combination of rotating the needle roller in a first direction and the force exerted by the spring can result in the needle roller pressing against the ramp, which prevents further rotation of the roller. When the needle roller is rotated in the opposite direction, it is free to rotate subject to a small amount of resistance from the spring. The clutching effect of the spring and the ramp means that the unidirectional bearing transmits torque in one direction with a high indexing accuracy and does not transmit torque when rotated in the other direction.

In one embodiment, the unidirectional bearing 44 is a cam clutch unidirectional bearing such as a HF 0612 manufactured by INA USA Corporation of Fort Mill, S.C. In other embodiments, other types of unidirectional bearings having a high indexing accuracy can also be used in the construction of drum keys in accordance with the present invention.

A drum key in accordance with the present invention is constructed using the pieces illustrated in FIGS. 2A–2C by positioning the handle over the connecting shaft 22 of the first piece of the shaft 20 illustrated in FIG. 2A. The handle is typically positioned so that the threaded end 24 of the connecting shaft extends through the central bearing 40 of the handle. The drum key can be completed by threading the second piece 30 of the shaft 12 shown in FIG. 2B onto the threaded portion of the connecting shaft of the first piece of the shaft illustrated in FIG. 2A.

In one embodiment, the pieces shown in FIGS. 2A–2C are constructed using machined carbon steel. In other embodiments, machining or molds can be used to construct drum keys in accordance with the present invention. In addition, materials such as metals or plastics or a combination of metals and plastics can be used in the construction of drum keys in accordance with the present invention.

Figure 3:
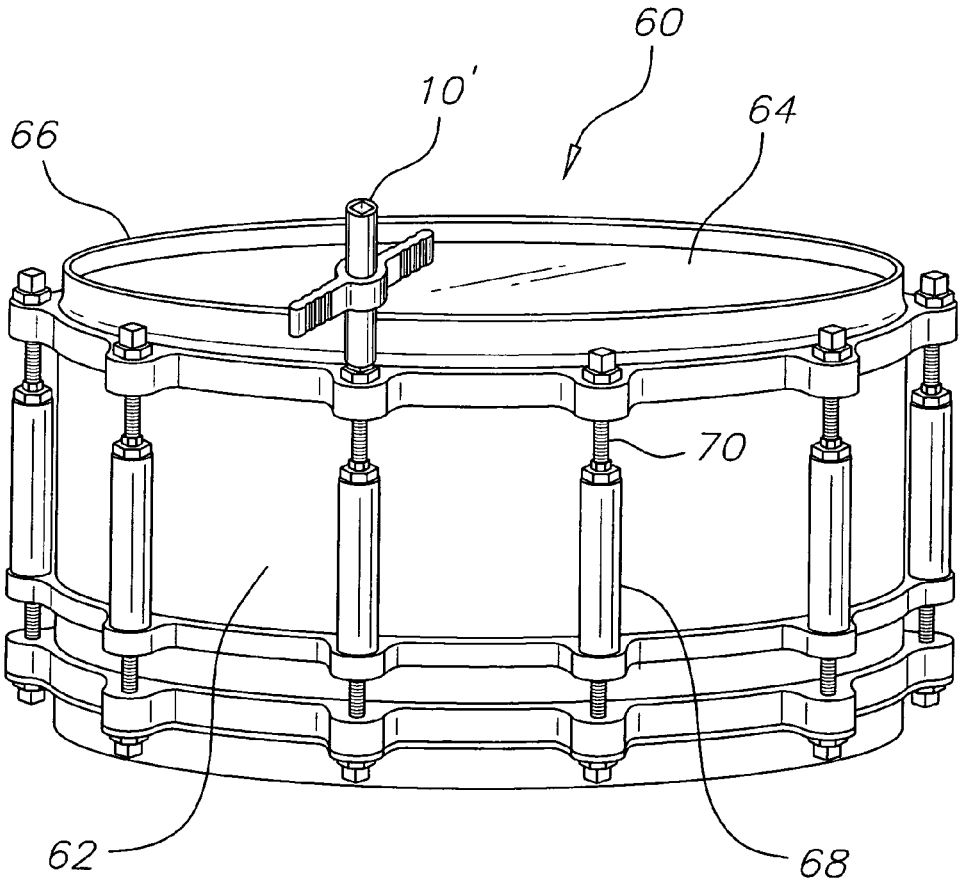
FIG. 3 is a perspective view of a drum key in accordance with the present invention engaging a tension rod of a drum

An embodiment of a drum key engaged with the terminal end of a tension rod of a snare drum is illustrated in FIG. 3. The snare drum 60 includes a cylindrical shell 62 having two openings over which two skins (or heads) 64 are stretched. Tension in each head is maintained using a system that includes a rim 66 (or hoop) and a series of lugs 68 for securing the rim using tension rods 70. The rim fits around the shell and the skin is held between the rim and the outside of the shell. Tightening the tension rods using the drum key 10' in accordance with the present invention causes the rim to stretch the skin and increases the tension in the drum head.

In other embodiments, tools in accordance with the present invention can be constructed in a manner similar to that described above for tightening or loosening nuts or rotating objects other than tension rods. In these embodiments, the socket opening of the shaft of the tool is configured to engage the nut or object being rotated and the tool functions in a manner similar to the operation of the drum key described above.

While the above description contains many specific embodiments of the invention, these should not be construed as limitations on the scope of the invention, but rather as an example of one embodiment thereof. Many other variations are possible. Accordingly, the scope of the invention should be determined not by the embodiments illustrated, but by the appended claims and their equivalents

What is claimed is:

1. A method of tuning a drum, comprising:

rotating a tension rod using a drum key that includes a shaft with a socket opening in one end and a handle connected to the shaft by a unidirectional bearing;

wherein the rotation of the tension rod further comprises:

inserting a portion of the tension rod inside the socket opening of the drum key;

holding the handle of drum key stationary; and simultaneously rotating the shaft of the drum key.

2. A method of tuning a drum including at least one tension rod having a terminal end using a drum key that includes:

a shaft including at least a first opening designed to engage the terminal end of a tension rod;

a handle that is connected to the shaft by a unidirectional bearing; and wherein the unidirectional bearing, constrains the handle to rotate in a first direction of rotation relative to the shaft;

the method comprising:

engaging the first opening of the shaft of the drum key with the terminal end of the tuning rod;

rotating the tuning rod and shaft in a second direction of rotation opposite the first direction of rotation by rotating the handle of the drum key in the second direction; and rotating the handle relative to the tuning rod and shaft by rotating the handle in the first direction.

3. The method of claim 2, wherein the unidirectional bearing is a cam clutch unidirectional bearing.

4. The method of claim 3, wherein the unidirectional bearing comprises:

a ring including at least one elongated cavity including a ramp;

a needle roller located within the cavity;

a spring located in the cavity;

wherein the spring is configured to press the needle roller against the ramp.

5. The method of claim 2, wherein:

the first opening configured to engage the terminal end of a tuning rod is located at a first end of the shaft; and the shaft includes a second opening configured to engage the terminal end of a tuning rod that is located at a second end of the shaft.

6. The method of claim 5 further comprising:

disengaging the first opening in the shaft of the drum key with the terminal end of the tuning rod;

engaging the second opening in the shaft of the drum key with the terminal end of the tuning rod;

rotating the tuning rod and shaft in the first direction of rotation opposite the first direction of rotation by rotating the handle of the drum key in the first direction; and rotating the handle relative to the tuning rod and shaft by rotating the handle in the second direction.

7. The method of claim 6, wherein the unidirectional bearing is a cam clutch unidirectional bearing.

8. The method of claim 5, wherein the unidirectional bearing comprises:

a ring including at least one elongated cavity including a ramp;

a needle roller located within the cavity;

a spring located in the cavity;

wherein the spring is configured to press the needle roller against the ramp.

9. The method of claim 2, wherein the amount of play in the second direction of rotation tolerated by the unidirectional bearing is not significant in the tuning of a drum.

* * * * *